US008437646B2

(12) United States Patent
Baxter et al.

(10) Patent No.: US 8,437,646 B2
(45) Date of Patent: May 7, 2013

(54) DUAL NIP MULTI-FEED DETECTION AND CONTROL SYSTEM

(75) Inventors: Nicholas Baxter, Northfordshire (GB); Andrew Hill, Hertfordshire (GB); Andrew Ashwood, Hertfordshire (GB); Nicholas Gates, Hertfordshire (GB); Robert Sanders, Hertfordshire (GB); Andrew Williams, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/585,879

(22) Filed: Aug. 15, 2012

(65) Prior Publication Data

US 2012/0306147 A1 Dec. 6, 2012

Related U.S. Application Data

(62) Division of application No. 13/017,081, filed on Jan. 31, 2011, now Pat. No. 8,280,263.

(51) Int. Cl.
*G03G 15/00* (2006.01)
*B65H 7/02* (2006.01)

(52) U.S. Cl.
USPC ..... 399/16; 399/18; 399/22; 399/388; 271/262; 271/265.04

(58) Field of Classification Search ..... 399/16, 399/388, 397, 391, 401, 18, 22, 21; 271/10.1, 271/271/225, 10.02, 10.03, 262, 265.04, 271/186, 184
See application file for complete search history.

(56) References Cited

U.S. PATENT DOCUMENTS

| | | | | |
|---|---|---|---|---|
| 2,892,629 | A | 6/1959 | Osgood, Jr. et al. | |
| 3,895,790 | A | 7/1975 | Hoyer et al. | |
| 4,060,232 | A | 11/1977 | Gibson | |
| 4,487,506 | A * | 12/1984 | Repp et al. | 399/401 |
| 5,106,075 | A * | 4/1992 | Wafford et al. | 271/186 |
| 5,382,013 | A * | 1/1995 | Walsh | 271/186 |
| 5,720,478 | A * | 2/1998 | Carter et al. | 271/186 |
| 6,674,979 | B2 | 1/2004 | Nagano | 399/68 |
| 7,080,834 | B2 | 7/2006 | Asari | 271/176 |
| 7,597,320 | B2 | 10/2009 | Matsumoto et al. | 271/225 |
| 2007/0048060 | A1 * | 3/2007 | Sonoda | 400/636 |
| 2009/0160119 | A1 * | 6/2009 | Komuro | 271/10.11 |

* cited by examiner

*Primary Examiner* — Matthew G Marini

(57) ABSTRACT

A paper feed system for use in a printing apparatus that detects multi-feeds and separates all sheets while allowing a single sheet to continue into the machine includes a nip with a drive roller for feeding sheets. A reversible pressure roller downstream of the drive roller is connected to a motor, but idles in the direction of the paper feed in normal operation. When a multi-feed is detected, the motor is turned ON and the reversible pressure roll actuated by a controller. The reversible pressure roller has more friction with the sheet in its contact than the friction between sheets. This drives the sheet in contact backwards.

20 Claims, 3 Drawing Sheets

DUAL NIP MULTI-FEED DETECTION AND CONTROL SYSTEM

CROSS-REFERENCE TO RELATED APPLICATIONS

This is a divisional of U.S. application Ser. No. 13/017,081 filed Jan. 31, 2011 by the same inventors, now U.S. Pat. No. 8,280,263, and claims priority therefrom. This divisional application is being filed in response to a restriction requirement in that prior application.

BACKGROUND

1. Field of the Disclosure

This invention relates in general to an image forming apparatus, and more particularly, to an image forming apparatus including a system that that is capable of detecting and separating multi-fed sheets whilst allowing individual single sheets to continue feeding.

2. Description of Related Art

Multi-feeds continue to be a problem when separating and feeding sheets from a stack of sheets within the sheet handling industry. A multi-feed occurs when two or more sheets are fed at once and can cause several problems. Typically, a multi-feed will jam somewhere in a machine, either due to the sheets not moving "as one" or timing issues as the sheets aren't exactly on top of one another so the length of the fed sheet appears longer than the machine expects. If the sheets make it through the whole machine the user can find blank sheets within large print runs, or in the case of duplex printing blank sides. All representations of multi-feed are an annoyance to the user and costly in terms of wasted paper and toner on jobs that need to be re-run, the extra electricity consumed in re-running jobs and the cost of time spent by the user either clearing the jam or re-running the jobs. Reducing the number of multi-feeds experienced will improve the overall user experience. Multiple solutions have been advanced for detecting and separating them. Most of the solutions are only capable of dealing with two sheets fed together.

For example, in U.S. Pat. No. 2,892,629 an arrangement is shown in which one of the two rollers between which the sheets pass is positively driven, but the other roller is a retard roller and is not positively driven. The latter roller is freely rotatable on a shaft and is spring urged to turn in a direction opposite to that of the positively driven roller. When only one sheet is passing between the two rollers, the friction is such as to cause the retard roller to turn in the direction of motion of the sheet and against the spring bias. However, when two sheets are disposed between the two rollers, the first sheet, bearing against the positively driven roller, is advanced while the second sheet is moved to the rear, under the influence of the spring biased retard roller which now rotates in the opposite direction to sheet transfer. U.S. Pat. No. 3,895,790 also uses a retard roller arrangement in which the retard roller is reversed when a multiple feed occurs. The prior art devices use a slip clutch system to provide forward movement when a multiple feed is not present. All of these devices depend upon the relative friction between the positively driven roller and the sheet to be advanced as being greater than the friction between the sheet to be advanced and the sheet or sheets to be returned. In U.S. Pat. No. 4,060,232 a garter spring drive is used to rotate a retard roll in a sheet reversing direction when multiple sheets are in a nip formed by a retard roll and a positively driven separator roll. When one sheet is in the nip, slippage occurs between the garter spring and pulleys so that the retard roll turns with the separator roll in a paper feed direction. All of the patents mentioned hereinbefore are included herein by reference.

Even though these solutions are useful, there is still a need for a multi-feed system that will facilitate detection and separation of more than two sheets while reliably feeding sheets one at a time.

SUMMARY OF THE DISCLOSURE

Accordingly, a system is disclosed that detects multi-feeds and separates all sheets allowing a single sheet to continue into the machine. The system includes a nip with a standard drive roller for feeding sheets. A reversible pressure roller downstream of the drive roller idles in the direction of the paper feed in normal operation. When a multi-feed is detected, the pressure roller is turned ON using appropriate timing. This roller has more friction with the sheet in its contact than the friction between sheets. This drives the sheet in contact backwards. This sheet can be diverted to a separate paper path using a gate mechanism and, if desired, fed back into the sheet stream or feed path.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Referring now to FIG. 1, a conventional electrostatographic machine or printer is represented by block 8. It includes a charge receptor or photoreceptor having an imageable surface and rotatable in a predetermined direction to be uniformly charged by a charging device and imagewise exposed by an exposure device to form an electrostatic latent image on the surface. The latent image is thereafter developed by a development apparatus that, for example, includes a developer roll for applying a supply of charged toner particles to the latent image. The charged toner particles adhere to appropriately charged areas of the latent image. The surface of the photoreceptor then moves to a transfer zone. Simultaneously, a print sheet onto which a desired image is to be printed is drawn from a sheet supply stack of a sheet feeding system and conveyed along a sheet path to the transfer zone.

At the transfer zone, the print sheet is brought into contact with the surface of the photoreceptor, which at this point is carrying toner particles thereon. A corotron at the transfer zone causes the toner image on the photoreceptor to be electrostatically transferred to the print sheet. The print sheet is then forwarded to subsequent stations, as is familiar in the art, including a fusing station to fuse the image to the copy sheet and then to an output tray. The reproduction machine 8 includes a controller or electronic control subsystem (ESS) which is preferably a programmable, self-contained, dedicated mini-computer having a central processor unit. As such, it is the main control system for components and other subsystems including paper feeding in machine 8.

Figure 1:
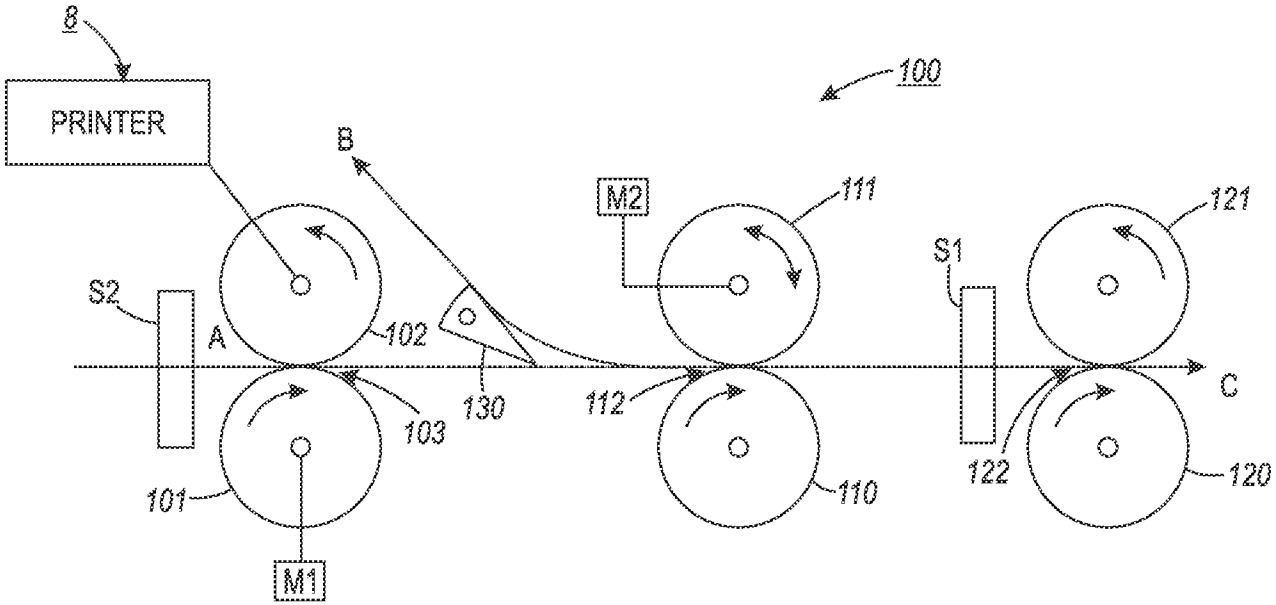
FIG. 1 is a frontal view of a schematic diagram of an alternative multi-feed detection and control system of the present disclosure.

In further reference to FIG. 1, the multi-feed detection and control system 100 is illustrated in detail and is adapted to detect multi-feeds and separate all sheets while allowing a single sheet to continue into machine 8. As illustrated, multi-feed detection and control system 100 includes a paper path C through which media, including sheets of all types, are conveyed to receive images thereon. A paper or sheet detection sensor S2 is positioned at an entry point A for paper entering a first drive roll nip 103 formed by drive roll 101 and idler roll 102, a second drive roll nip 112 formed by drive roll 110 and reversible roll 111 powered by motor M2, and a third drive roll nip 122 formed by drive roll 120 and idler roll 121. Drive roll 101 has a motor M1 drivingly connected thereto which also drives rolls 110 and 120 in the direction of paper feed. A multi-feed detection sensor 51 is shown positioned downstream of drive nip 112 and upstream of drive nip 122. Multi-feed sensor S1 is preferably an optical sensor; however, any conventional sensor could be used, if desired.

A gravity gate 130 positioned in paper path C, such that, it allows paper to pass under it in the paper feed direction and pass over it in the direction of exit point B when multi-feeds are detected. Ordinarily, drive roller 110 is ON and rotating in the paper feed direction, while reversible roller 111 attached to motor M2 idles against it. When a multi-feed is detected by S1, motor M2 is turned ON which causes roller 111 that is attached to it to rotate in the opposite direction to the paper feed direction. Roller 111 has greater friction with the paper than between the paper sheets, so when a dual-feed occurs roller 111 attached to motor M2 has enough friction to drive the upper sheet backwards into gravity gate 130 while the lower sheet continues to move in the forward direction. The trail edge of the multi-feed must pass gravity gate 130 to allow it to drop before motor M2 is turned ON, therefore, when the multi-fed sheet is fed backwards it exits from the system at point B. To ensure that the remaining "single" sheet is not fed in the wrong direction, roller 111 must have a lower coefficient of friction than drive roller 110 feeding the paper in the correct direction. An advantage to this configuration is that through experimentation it has been found that roller 111 rotating in the opposite direction to the paper feed direction will feed out a single sheet at a time until there is only one remaining which then carries on in the correct direction. Thus, when more than two sheets are fed, roller 111 rotating in the opposite direction to the paper feed direction will feed out a single sheet at a time to exit point B until there is only one remaining which then carries on in the sheet feed direction. Sheets exiting point B can either be conveyed to an output tray or re-fed into paper path C past entry point A to receive images thereon.

Figure 2:
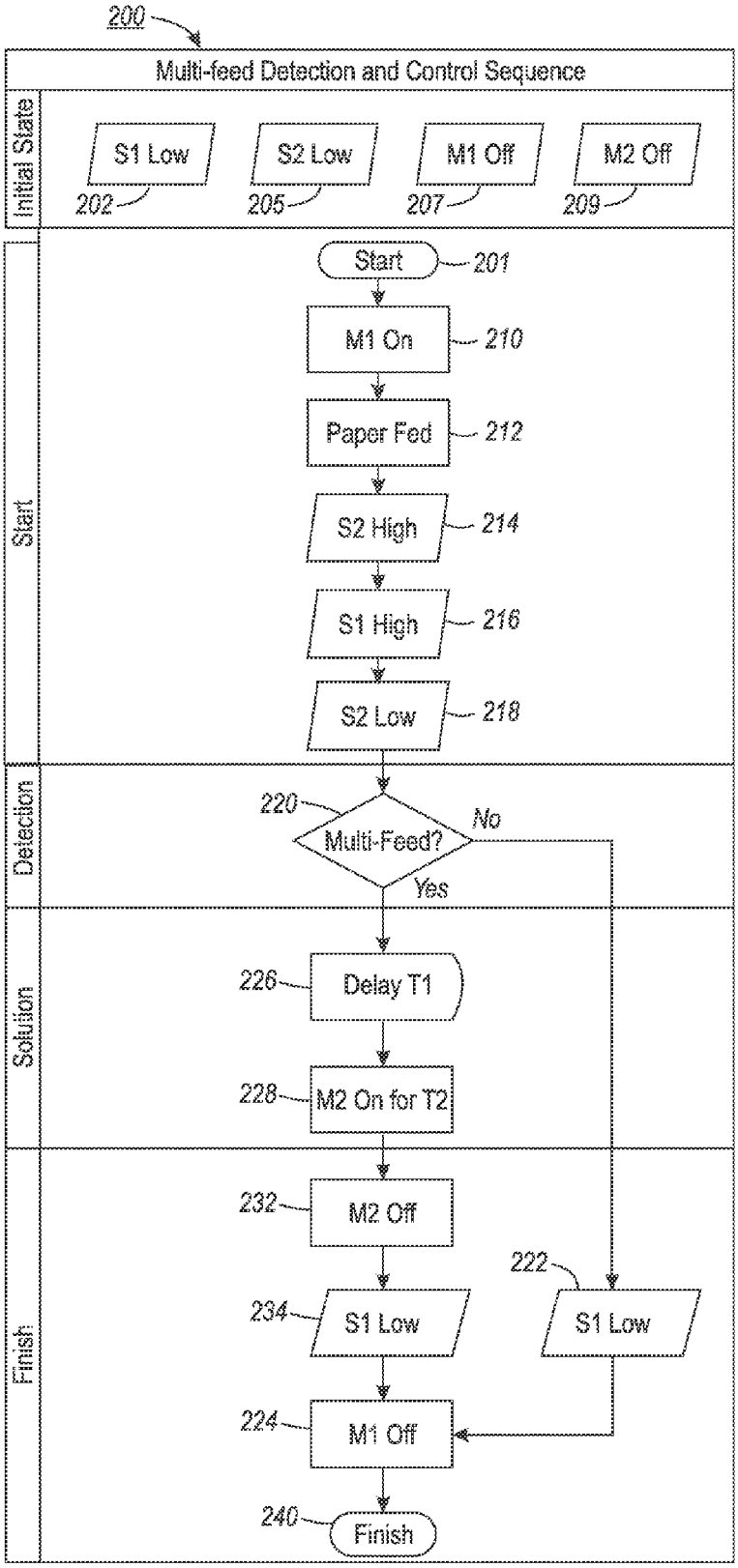
FIG. 2 is a flow chart describing system operation.

A flow chart 200 is shown in FIG. 2 which describes the system operation. That is, in its initial state, sensors S1 and S2 in blocks 202 and 205, respectively, are Low and motors M1 and M2 in blocks 207 and 209 are OFF. But once the start button 201 is pushed, sheets are fed from a paper supply (not shown) and motor M1 in block 210 is turned ON. Paper is fed in block 212, sensor S2 in block 214 is High, sensor S1 in block 216 is High and sensor S2 goes Low in block 218 because in the environment tested (feeding A4 long edge sheets) sensors S1 and S2 were about 200 mm apart, and thus, the trail edge of a sheet would pass through sensor S2 before the system had made a decision. In decision block 220, if no multi-feed is detected sensor S1 is Low and motor M1 is turned OFF in block 224. The job is finished in block 240. However, if a multi-feed is detected in decision block 220, a delay T1 is introduced in block 226 following sensor S2 going low in order to allow for the trail edge of the sheet to pass gravity gate 130. Afterwards, as shown in block 228, motor M2 is turned ON for a predetermined time T2 in order to feed sheet multi-feeds backwards and out of exit point B. Subsequently, motor M2 is turned OFF in block 232, sensor S1 is now Low at block 234 and motor M1 is OFF in block 224 as the lowermost sheet in the multi-feed continues to feed and the job is finish at block 240. If desired, sensor S1 could be omitted and instead a multi-feed sensor placed anywhere prior to the entry point A.

Figure 3:
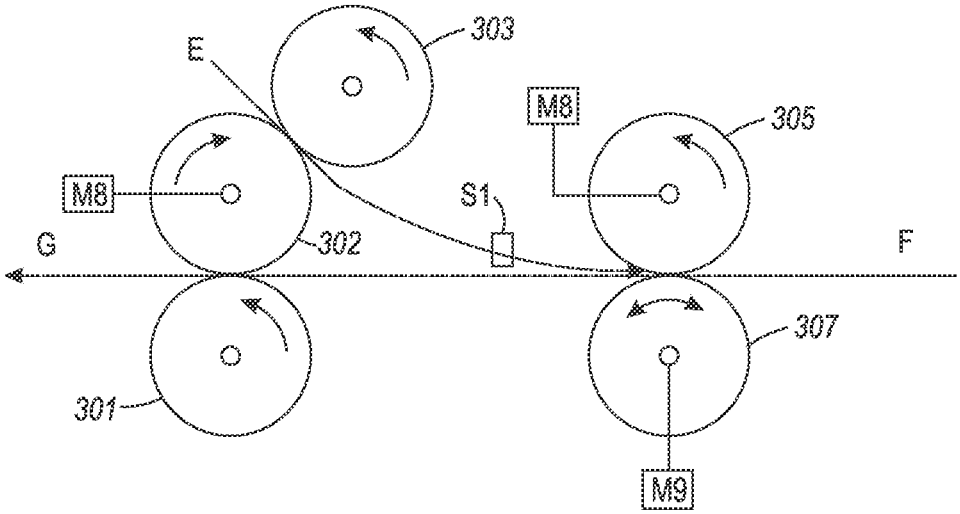
FIG. 3 is a configuration for multi-feed detection and separation in accordance with the present disclosure.

An embodiment 300 of the present disclosure is shown in FIG. 3 that eliminates the need for gravity gates, but still operates under the same principles of FIG. 1. This configuration includes tri-rollers 301, 302 and 303 positioned upstream of drive roll 305 and reversible roll 307. The tri-rollers are in frictional or geared contact with each other, to provide two spaced-apart nips, one being an input nip formed by rollers (302, 303) to an associated paper path to a downstream imaging device, and the other being an output nip formed by rollers (301, 302) for extracting each sheet of a multi-feed except the uppermost sheet from the paper path. A motor M8 is drivingly attached to drive roll 302 and drive roll 305. A motor M9 is attached to reversible roller 307. The entry point into the system is at E and sheets are directed into paper path F for conveyance to an image transfer station (not shown). When a multi-feed is sensed by sensor S1, reversible motor M9 is actuated and the lower sheet is fed backwards in the direction of arrow G after the trail edge has dropped down while the upper sheet continues through the system (paper path F) after a predetermined pause for sheets below it to be purged.

In recapitulation, a multi-feed detection and control system has been disclosed that comprises structure and methods configured to separate multi-fed sheets conveyed in a paper path and re-feed the separated sheets into the paper path or drive them into a purge tray. The system includes a reversible roll that idles on a driver roll in the direction of paper feed when single sheets are conveyed, but when a multi-feed is detected the reversible roll is actuated to reverse rotation and drive all sheets above a lowermost single sheet in a reverse and exit direction while the lowermost sheet is delayed for a predetermined time and then fed in the paper feed direction. The system is compatible with paper paths that are vertical, horizontal or inclined at predetermined angles, and it should also be understood that the system could equally be used on any device that feeds media, and not necessarily for marking media, e.g., in automatic teller machines.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A multi-feed detection and separation system, comprising:

a gateless, dual nip, tri-roll device adapted to drive non-imaged sheets in a sheet feed direction with a first of said dual nips and away from said sheet feed direction with a second of said dual nips;

a drive nip positioned downstream of said dual nip tri-roll device, said drive nip including a drive roll adapted to rotate only in a counter clockwise direction and a reversible pressure roll mating therewith, said reversible pressure roll being adapted to idle on said drive roll in said sheet feed direction when only one sheet is within said drive nip and reverse rotation direction when more than one sheet is within said drive nip to drive all sheets but the uppermost sheet in a direction reversed to said sheet feed direction; and a multi-feed sensor positioned upstream of said drive nip and adapted to send a signal to said reversible pressure roll only when more than one sheet is entering said drive nip.

2. The multi-feed detection and separation system of claim 1, wherein said multi-feed sensor is an optical sensor.

3. The multi-feed detection and separation system of claim 1, wherein feeding of said uppermost sheet is delayed until there is only one sheet remaining within said drive nip and then feeding of said uppermost sheet is continued.

4. The multi-feed detection and separation system of claim 3, wherein an entry point for sheets into said drive nip is from above said drive nip and in an inclined plane.

5. The multi-feed detection and separation system of claim 4, wherein an exit point for sheets driven out of said dual nip tri-roll device in a reverse direction is in a horizontal plane.

6. The multi-feed detection and separation system of claim 1, wherein the lowermost sheet of a detected multi-feed is fed backwards after the trail edge has dropped down from said first of said dual nips of said tri-roll device into said sheet feed direction.

7. The multi-feed detection and separation system of claim 1, wherein said multi-feed detection and separation system is incorporated into a reprographic device.

8. A tri-roll multi-feed detection and separation method, comprising:

providing a gateless, dual nip, tri-roll device adapted to drive sheets prior to receiving images thereon in a sheet feed direction with a first of said dual nips and away from said sheet feed direction with a second of said dual nips;

providing a drive nip positioned downstream of said gateless, dual nip, tri-roll device, said drive nip including a drive roll adapted to rotate only in said sheet feed direction and a reversible pressure roll mating therewith, said reversible pressure roll being adapted to idle on said drive roll in said sheet feed direction when only one sheet is within said drive nip and reverse rotation direction when more than one sheet is within said drive nip to drive all sheets but the uppermost sheet in a direction reversed to said sheet feed direction; and providing a multi-feed sensor positioned upstream of said drive nip and adapted to send a signal to actuate said reversible pressure roll when more than one sheet is entering said drive nip.

9. The method of claim 8, wherein said multi-feed sensor is an optical sensor.

10. The method of claim 9, wherein feeding of said uppermost sheet of said multi-feed is delayed until there is only one sheet remaining and then feeding of said uppermost sheet is continued.

11. The method of claim 10, wherein the entry point for sheets into said drive nip is from above said drive nip and in an inclined plane.

12. The method of claim 11, wherein the exit point for sheets driven out of said dual nip tri-roll device in a reverse direction is in a horizontal plane.

13. The method of claim 12, wherein the lowermost sheet of a detected multi-feed is fed backwards after the trail edge has dropped down due to gravity from said first of said dual nips of said tri-roll device into said sheet feed direction.

14. The method of claim 8, including positioning said drive nip downstream of said gateless dual nip tri-roll device as the first nip encountered by sheets being driven by said first of said dual nips.

15. The method of claim 14, including mounting tri-rolls of said dual nip tri-roll device on three shafts with two of said three shafts being mounted in the same vertical plane and a third of said three shafts being mounted in a different vertical plane.

16. The method of claim 15, wherein said different vertical plane is downstream of said vertical plane of said two of said three shafts.

17. A printer that includes a multi-feed detection and separation system, comprising:

a gateless, dual nip, tri-roll device adapted to drive sheets in a sheet feed direction with a first of said dual nips and away from said sheet feed direction with a second of said dual nips;

a drive nip positioned downstream of said gateless, dual nip, tri-roll device, said drive nip including a drive roll adapted to rotate only in said sheet feed direction and a reversible pressure roll mating therewith, said reversible pressure roll being adapted to idle on said drive roll in said sheet feed direction when only one sheet is within said drive nip and reverse rotation direction when more than one sheet is within said drive nip to drive all sheets but the uppermost sheet in a direction reversed to said sheet feed direction; and a multi-feed sensor positioned upstream of said drive nip and adapted to send a signal that actuates said reversible pressure roll only when more than one sheet is entering said drive nip.

18. The printer of claim 17, wherein feeding of said uppermost sheet is delayed until there is only one sheet remaining within said drive nip and then feeding of said uppermost sheet is continued.

19. The printer of claim 18, wherein the entry point for sheets into said drive nip is from above said drive nip and in an inclined plane.

20. The printer of claim 19, wherein an exit point for sheets driven out of said dual nip tri-roll device in a reverse direction is in a horizontal plane.

* * * * *